US008467561B2

(12) United States Patent
Tung et al.

(10) Patent No.: US 8,467,561 B2
(45) Date of Patent: Jun. 18, 2013

(54) EARPHONE DEVICE WITH A FUNCTION OF SOUND QUALITY REGULATION AND REGULATING METHOD THEREOF

(75) Inventors: Chiu-Yun Tung, Taichung (TW); Hui-Yin Liang, Tachung (TW); Ching-Wen Chang, Taichung (TW)

(73) Assignee: Merry Electronics Co., Ltd., Taichung (TW)

( * ) Notice: Subject to any disclaimer, the term of this patent is extended or adjusted under 35 U.S.C. 154(b) by 307 days.

(21) Appl. No.: 12/815,127

(22) Filed: Jun. 14, 2010

(65) Prior Publication Data

US 2011/0305360 A1 Dec. 15, 2011

(51) Int. Cl.
*H04R 25/00* (2006.01)

(52) U.S. Cl.
USPC ..... 381/373

(58) Field of Classification Search
USPC ..... 381/373, 379
See application file for complete search history.

(56) References Cited

U.S. PATENT DOCUMENTS

| | | | | |
|---|---|---|---|---|
| 4,807,612 | A * | 2/1989 | Carlson | 128/868 |
| 4,852,177 | A * | 7/1989 | Ambrose | 381/338 |
| 5,544,253 | A * | 8/1996 | Nagayoshi et al. | 381/385 |
| 7,356,156 | B2 * | 4/2008 | R egg | 381/379 |
| 8,055,007 | B2 * | 11/2011 | Kim | 381/382 |
| 8,107,663 | B2 * | 1/2012 | Lin | 381/371 |
| 2012/0063619 | A1 * | 3/2012 | Hildebrandt et al. | 381/310 |

* cited by examiner

*Primary Examiner* — Jeffrey Donels
(74) *Attorney, Agent, or Firm* — Morris Manning & Martin LLP; Tim Tingkang Xia, Esq.

(57) ABSTRACT

An earphone device with a function of sound quality regulation is provided. The earphone includes a housing, a cover, a speaker and a regulating device. The housing has an accommodating space for receiving the speaker and a plurality of regulating holes for connecting the accommodating space to the outside. One end of the regulating device is fixed on the cover. A blocking portion, which is disposed on the other end of the regulating device and extends into the accommodating space, can partially or completely block the regulating holes when the cover is turned, thereby regulating the leakage between the accommodating space and the outside to achieve different output sound quality.

6 Claims, 6 Drawing Sheets

EARPHONE DEVICE WITH A FUNCTION OF SOUND QUALITY REGULATION AND REGULATING METHOD THEREOF

BACKGROUND OF THE INVENTION

1. Field of the Invention

The present invention relates to an earphone device, and more particularly to an earphone device which can regulate sound quality based on regulating a cover connected with a regulating device and corresponding regulation method.

2. Description of Related Art

Refer to FIG. 1, a conventional earphone device includes a housing 10 with a receiving portion 11. The receiving portion 11 includes an inner cavity for receiving components, such as a speaker and a driving circuit and so on, and a plurality of pressure relief holes 12 formed thereon for connecting the inner cavity to the outside.

The number of the pressure relief holes 12 in the housing 10 of the conventional earphone device is determined according to specific group of consumers, so the sound pressure in the inner cavity is a constant, which determines the frequency characteristic of the earphone device. However, since conventional earphone devices may be applied in connecting mobile phones for communication or in music players which may store hundreds of or thousands of songs, it needs different frequency characteristics to meet different kinds of sound quality requirements. The constant sound pressure in the inner cavity causes that the conventional earphone device can only be adapted for a special audio performance and users cannot regulate sound quality freely according to themselves. Hence, conventional earphone devices have the shortcoming of low variability, which needs to be overcome.

SUMMARY OF THE INVENTION

An object of the present invention is to provide an earphone device with a function of sound quality regulation.

To achieve the above-mentioned object, an earphone device with a function of sound quality regulation in accordance with the present invention is provided. The earphone device includes a housing, a cover, a speaker and a regulating device, wherein the housing has a plurality of regulating holes and the housing combines with the cover to form an accommodating space for receiving the speaker, and the accommodating space is connected to the outside by the regulating holes; one end of the regulating device is fixed on the cover; a blocking portion, which is disposed on the other end of the regulating device, can partially or completely block the regulating holes when the cover turns, thereby regulating the leakage from the accommodating space to the outside to achieve different output sound quality.

Additionally, another object of the present invention is to provide a method of regulating sound quality of an earphone device, wherein the earphone device includes a housing and a cover, and the housing has an accommodating space for receiving a speaker and a plurality of regulating holes for connecting the accommodating space to the outside and the cover is combined with a regulating device of which a blocking portion extends into the accommodating space, the method includes: turning the cover to drive the regulating device; and selectively blocking the regulating holes via the blocking portion of the regulating device, thereby changing leakage from the accommodating space to the outside.

In comparison with conventional technologies, the present invention has the advantages that the present invention can regulate the leakage between the sound wave resonant room inside the earphone device and the outside to achieve different output sound quality, so that users can regulate proper output sound quality freely on their own will, accordingly, the earphone device of the present invention has high variability and is more sufficient to meet users' requirements.

DETAILED DESCRIPTION OF THE PREFERRED EMBODIMENTS

The following is to explain an earphone device with a function of sound quality regulation and regulating method thereof according to the preferred embodiments of the present invention in combination with related drawings.

Figure 1:
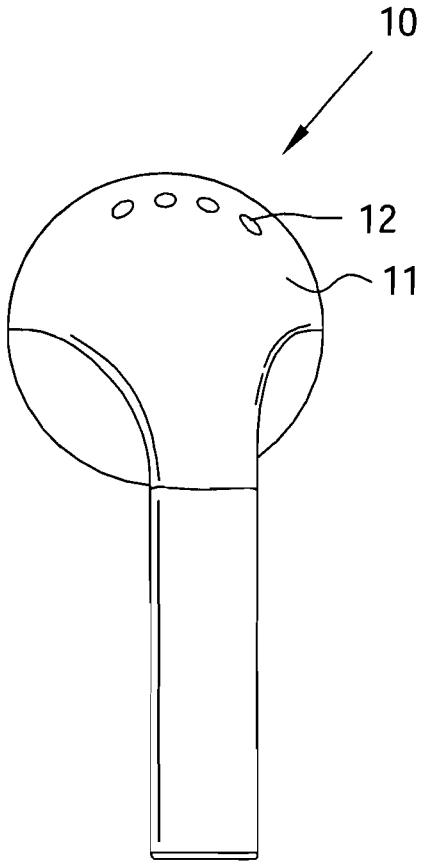
FIG. 1 (Prior art)
FIG. 1 is a top view of a conventional earphone device.
Figure 2:
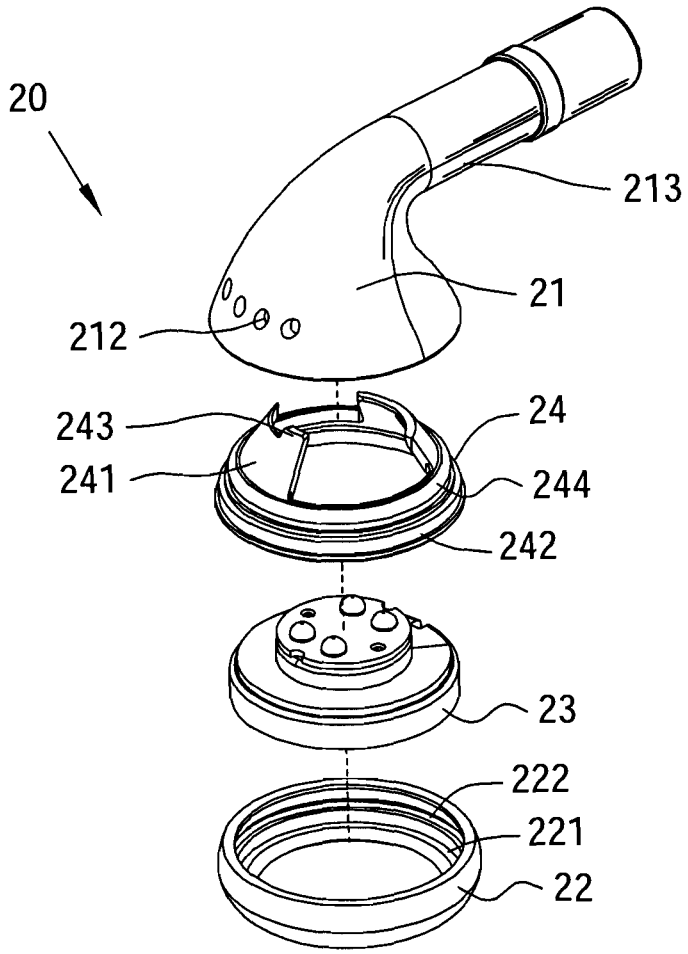
FIG. 2 is an exploded perspective view of a preferred embodiment of the present invention.

Please refer to FIG. 2. FIG. 2 is an exploded perspective view of an earphone device with a function of sound quality regulation of a first preferred embodiment of the present invention. The earphone device 20 of the present invention includes a housing 21, a cover 22, a speaker 23 and a regulating device 24. The housing 21 has an accommodating space 211 (please refer to FIG. 3 coordinately) and a plurality of regulating holes 212, and the accommodating space 211 is connected to the outside by the regulating holes 212. The regulating device 24 is movably combined with the housing 21 and extends a blocking portion 241 into the accommodating space 211. During the movement of the regulating device 24, the blocking portion 241 may completely block, partially block or unblock the regulating holes 212. Further, the speaker 23 is disposed in the accommodating space 211 and exerts sound pressure in the accommodating space 211 when outputting a sound. The cover 22 is combined with the regulating device 24, and the regulating device 24 is moved when the cover 22 is turned opposite to the housing 21 by a user.

Furthermore, one end of the housing 21 is cap-shaped, thereby forming the accommodating space 211, and an extended tube 213 is disposed on the other end of the housing 21. A signal line electrically connected to the speaker 23 extends through the extended tube 213.

In this embodiment, the regulating device 24 includes a blocking portion 241, a combined portion 242 and a protruding ring portion 244. The regulating device 24 engages with a trench 215 of the housing 21 (please refer to FIG. 4) via the protruding ring portion 244. Because the trench 215 and the protruding ring portion 244 are all annular and engaged by locking not adhering, the regulating device 24 can be turned opposite to the housing 21. Also, the diameter of the combined portion 242 is greater than that of the annular portion of the speaker 23 and the combined portion 242 has a protruding ring portion for engaging with a trench 222 of the cover 22, so that the regulating device 24 can be driven when the cover 22 is turned opposite to the housing 21. Moreover, the blocking portion 241 extended upwards from the combined portion 242 along the cap-shaped curved surface of the housing 21 and the blocking portion 241 has a projecting portion 243. A ramp portion 214 is formed in the accommodating space 211, adjacent to the regulating holes 212. The projecting portion 243 of the blocking portion 241 may be moved along the ramp portion 214.

It must be explained that, in this embodiment, the cover 22 is annular, and besides the trench 222, the cover 22 also has a supporting portion 221 formed on the inner annular face for supporting and fixing the speaker 23.

Figure 3:
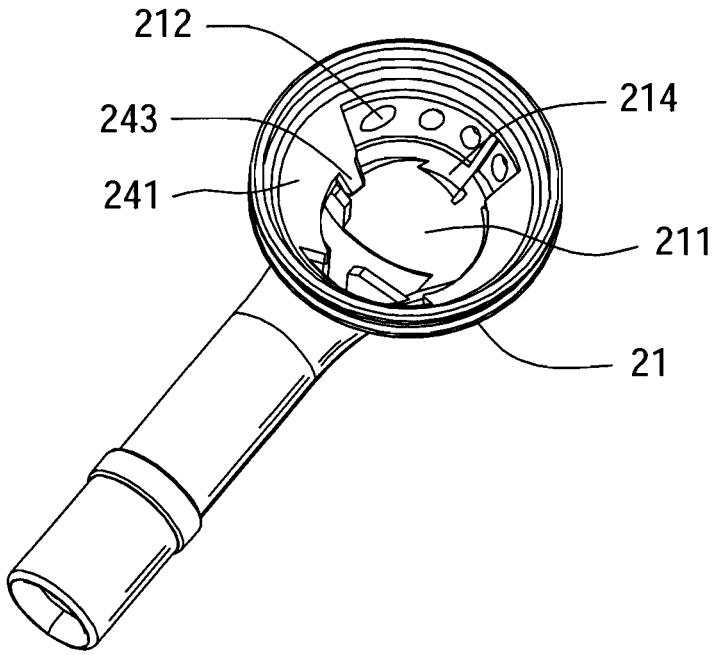
FIG. 3 is a schematic view of the present invention, in a first regulated state.
Figure 4:
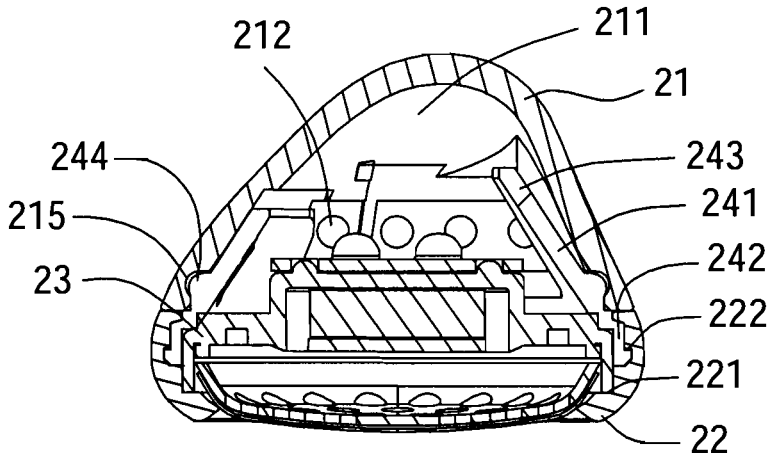
FIG. 4 is a cross-sectional view of the present invention, in the first regulated state.
Figure 5:
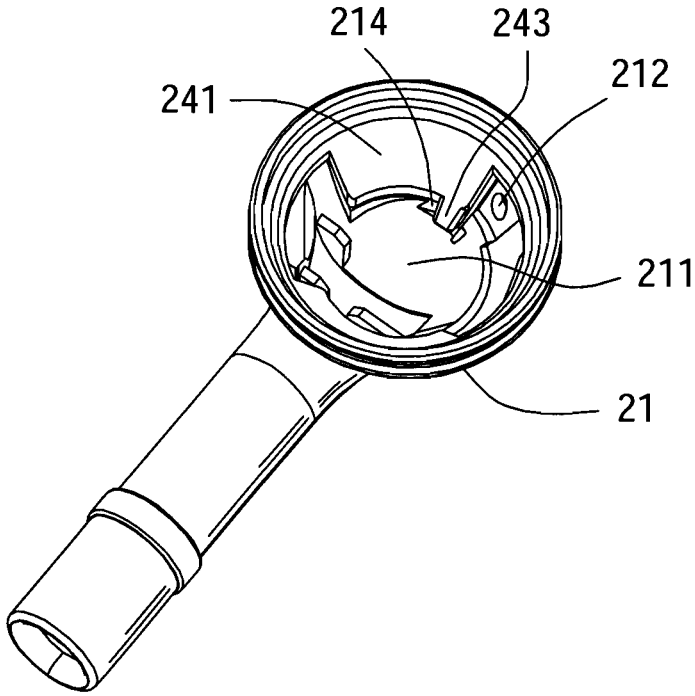
FIG. 5 is a schematic view of the present invention, in a second regulated state.
Figure 6:
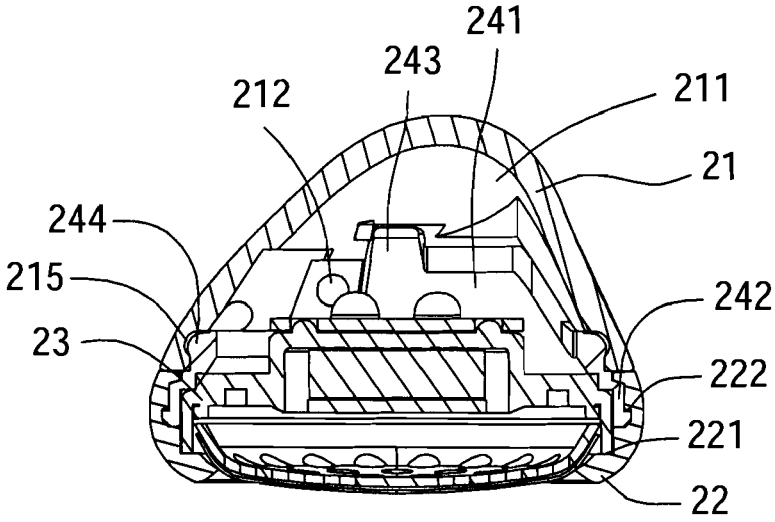
FIG. 6 is a cross-sectional view of the present invention, in the second regulated state.

Please refer to FIGS. 3 to 6. FIGS. 3 to 6 are respectively schematic views and cross-sectional views of the earphone device with a function of sound quality regulation of the present invention, in a first regulated state and a second regulated state. As shown in FIG. 3 and FIG. 4, in the first regulated state, the blocking portion 241 of the regulating device 24 doesn't block any of the regulating holes 212 and air in the accommodating space 211 can flow out of the housing 21 through the four regulating holes 212. As shown in FIGS. 5 to 6, when the cover 22 is turned anticlockwise, the projecting portion 243 of the regulating device 24 moved along the ramp portion 214 and the blocking portion 241 gradually closes the regulating holes 212. In FIG. 5, the blocking portion 241 blocks three regulating holes 212 and the other regulating hole 212 is kept open to connect the accommodating space 211 to the outside, and at this time, the projecting portion 243 of the regulating device 24 is moved to the top of the ramp portion 214. If the cover 22 continues to be turned in the same direction, then the projecting portion 243 of the regulating device 24 is moved to the back of the ramp portion 214 to be locked so that the blocking portion 241 blocks all the regulating holes 212 completely; If the cover 22 is turned in the opposite direction, then it needs a slight external force to make the projecting portion 243 return to the ramp portion 214 and then move downwards.

It is worthy to be mentioned that the earphone device 20 of the preferred embodiment of the present invention is an earplug earphone, however, the structure of the present invention may also be applied in a in-ear earphone, and the changes which need to be made when the structure is applied in a in-ear earphone will become readily apparent to those skilled in the art, so the description is omitted.

Finally, the present invention further provides a method of regulating sound quality of an earphone device. The earphone device, like the earphone device as shown in FIGS. 2 to 6, includes a housing 21, a cover 22, a speaker 23 and a regulating device 24. The housing 21 has an accommodating space 211 for receiving the speaker 23 and a plurality of regulating holes for connecting the accommodating space 211 to the outside. The cover 22 is combined with the regulating device 24. A blocking portion 241 of the regulating device 24 extends into the accommodating space 211. The regulating method is as follows: turning the cover 22 to drive the regulating device 24 and selectively blocking the regulating holes 212 via the blocking portion 241 of the regulating device 24, thereby changing the leakage between the accommodating space 211 and the outside.

As described above, the earphone device with a function of sound quality regulation of the present invention enables users to regulate the leakage between the resonant room of the earphone device and the outside by turning the cover to drive the regulating device to achieve different output sound quality. Thereby, users can regulate proper output sound quality freely on their own will. Comparing with conventional earphone devices, the earphone device of the present invention has high variability and is more sufficient to meet users' requirements.

What are disclosed above are only the exemplary embodiments of the present invention and it is therefore not intended that the present invention be limited to the particular embodiments disclosed. It will be understood by those skilled in the art that various equivalent changes may be made depending on the specification and the drawings of the present invention without departing from the scope of the present invention.

What is claimed is:

1. An earphone device with a function of sound quality regulation, comprising:

a housing, having an accommodating space and a plurality of regulating holes, the accommodating space connected to outside by the regulating holes;

a regulating device, movably combined with the housing and extending a blocking portion into the accommodating space to selectively block the regulating holes during movement;

a speaker, disposed in the accommodating space; and a cover, combined with the regulating device and moved opposite to the housing for driving the regulating device.

2. The earphone device with a function of sound quality regulation as claimed in claim 1, wherein the housing has an annular trench formed in an inner surface thereof, and the regulating device has an annular protruding ring portion opposite to the trench of the housing for engaging with the trench of the housing.

3. The earphone device with a function of sound quality regulation as claimed in claim 1, wherein the cover is annular and has a trench formed in an inner annular face thereof, and the regulating device has a combined portion opposite to the trench of the cover for engaging with the trench of the cover.

4. The earphone device with a function of sound quality regulation as claimed in claim 3, wherein the combined portion of the regulating device is annular and has a protruding ring portion for engaging with the trench of the cover.

5. The earphone device with a function of sound quality regulation as claimed in claim 1, wherein the cover has a supporting portion formed thereon for supporting and fixing the speaker.

6. The earphone device with a function of sound quality regulation as claimed in claim 1, wherein the blocking portion of the regulating device has a projecting portion; a ramp portion is formed in the accommodating space, adjacent to the regulating holes; and the projecting portion moves along the ramp portion when the cover drives the regulating device.

* * * * *